United States Patent [19]

Cothrell et al.

[11] Patent Number: 4,525,955

[45] Date of Patent: Jul. 2, 1985

[54] ABRASIVE BELT CLEANING SYSTEM

[75] Inventors: LeRoy E. Cothrell, Cottage Grove, Oreg.; Raymond G. Fair, Osseo, Minn.

[73] Assignee: Timesavers, Inc., Minneapolis, Minn.

[21] Appl. No.: 572,467

[22] Filed: Jan. 20, 1984

Related U.S. Application Data

[63] Continuation of Ser. No. 313,344, Oct. 20, 1981, abandoned, which is a continuation of Ser. No. 236,883, Feb. 23, 1981, abandoned, which is a continuation of Ser. No. 80,137, Sep. 28, 1979, abandoned, which is a continuation of Ser. No. 872,369, Jan. 26, 1978, abandoned.

[51] Int. Cl.[3] ..... B24B 21/12; B24B 53/10

[52] U.S. Cl. ..... 51/135 R; 51/262 A; 51/273; 51/140

[58] Field of Search ..... 51/135 R, 140, 262 A, 51/270, 273, 356

[56] References Cited

U.S. PATENT DOCUMENTS

| | | | |
|---|---|---|---|
| 986,170 | 3/1911 | Heady | 51/262 A |
| 1,413,060 | 4/1922 | Roberts | 51/262 A |
| 2,261,614 | 11/1941 | Buckley | 51/273 |
| 2,411,085 | 11/1946 | Doherty | 51/140 |
| 2,563,096 | 9/1951 | Stewart | 51/262 A |
| 3,177,627 | 4/1965 | Guibert et al. | 51/262 A |
| 3,269,065 | 8/1966 | Nylund | 51/140 X |
| 3,282,665 | 11/1966 | Myers | 51/135 R |
| 3,812,622 | 5/1974 | Parsons | 51/262 A |
| 3,872,627 | 3/1975 | Schuster | 51/135 R |

FOREIGN PATENT DOCUMENTS

| | | | |
|---|---|---|---|
| 1037308 | 1/1957 | Fed. Rep. of Germany | 51/135 R |
| 421500 | 12/1974 | U.S.S.R. | 51/262 A |

*Primary Examiner*—Robert P. Olszewski

*Attorney, Agent, or Firm*—Orrin M. Haugen; Thomas J. Nikolai

[57] ABSTRACT

Apparatus for cleaning endless abrasive belts utilized for sanding and grinding operations, wherein substantially the entire belt is enclosed within a shroud and wherein intermittent blasts of compressed gaseous fluid are directed onto the surface of the belt as it traverses its orbital path. Specifically, the compressed gas is directed onto the surface of the belt within the shroud and at a point wherein the belt is wrapped about the surface of the roller, which opens the grid pattern slightly. The intermittent utilization of compressed gaseous fluid utilizes a substantially lower volume of compressed fluid than would be required on a continuous basis, and furthermore the arrangement has been found to clean the surfaces of abrasive belts more effectively than can be accomplished with a continuous discharge. The shroud which encloses substantially the entire length of the endless abrasive belt reduces dust discharge.

1 Claim, 5 Drawing Figures

ABRASIVE BELT CLEANING SYSTEM

This is a continuation of application Ser. No. 313,344, filed Oct. 20, 1981, now abandoned which was a continuation of application Ser. No. 236,883, filed Feb. 23. 1981, now abandoned, which was a continuation of application Ser. No. 080,137, filed Sept. 28, 1979, now abandoned, with application Ser. No. 080,137 having been a continuation of application Ser. No. 872,369, filed Jan. 26, 1978, now abandoned.

FIELD OF THE INVENTION

This invention relates to the field of sanding and grinding, and more specifically to improvements in the cleaning of endless abrasive belts which are used in such operations.

BACKGROUND OF THE INVENTION

Apparatus for sanding and grinding operations utilizing endless abrasive belts are widely used for treatment of surfaces of metal articles, and for surface dressing and dimensioning of lumber. Specifically, in the dimensioning of lumber, abrasive sanding is frequently utilized to provide dimensional stability, and also to control and eliminate modest bowing or warping of dimensioned lumber. When significant material removal is required, and particularly significant material removal of pine or other materials heavy in resinous substances such as pitch, the surface of the belts become loaded with material, thus reducing the effectiveness of the abrasive material to remove material from the work.

In the past, various apparatus and techniques have been utilized to remove adhering particles from the surface of abrasive belts. Such apparatus and techniques include the continuous application of compressed air, or combinations of air and liquid, such as air-water mixtures. In certain other structures, material removal from abrasive belt surfaces may be attempted by exposure of the belt surface to modest vacuum.

As is conventional in abrasive sanders or grinders, stock removal is achieved by utilizing either one or more abrading heads acting upon the exposed surface of the work. Typically, in the dressing and dimensioning of lumber, opposed abrading heads may be utilized, with conveyors acting upon the work so as to move the work into contact with the abrading heads. Typically, each abrading head includes a working surface such as a contact drum or platen supporting the abrasive belt along with a remotely positioned belt tensioning idler roller or drum, the rolls being mounted for rotation about parallel axes. Typically, the idler roll may further include means for maintaining constant tension in the belt, and also means for controlling the axial positioning of the belt on the rollers.

In applying a continuous flow of compressed fluid such as compressed air onto the surface of the belt, excessive quantities of the compressed fluid are required. It has been found that removal of adherent particles is enhanced if intermittent pulses of compressed fluid such as air are applied to the belt rather than a continuous flow. In other words, it appears that removal of adherent material may be improved if the quantity of such adherent material is permitted to build up modestly prior to removal. Shroud means are provided to envelop substantially the entire length of the belt, thereby reducing discharge of dust into the ambient.

SUMMARY OF THE INVENTION

Briefly, in accordance with the present invention, means are provided for establishing intermittent air flow onto the surface of a moving abrasive belt within a shroud, with dust and debris control being achieved by positioning shroud evacuation ports immediately adjacent the point at which the incoming air is delivered onto the moving belt. As indicated, spaced ports are provided in an elongated manifold, and jets of compressed air or other gaseous fluid are discharged directly onto the surface of the moving abrasive belt. The delivery of the incoming compressed air or other fluid is controllably pulsed, thus achieving a flow which impinges upon the surface of the moving belt for a duration sufficient to contact the entire surface of the belt for several revolutions thereof. As can be appreciated, abrasive belts are moved at a high surface velocity, and the utilization of compressed air for a period of several seconds will, of course, treat the entire surface of the belt on multiple passes thereof. Under these conditions, however, it nevertheless has been found that the quantity of debris or other adherent material removed is increased, and the quality of improvement of the cleaning or treatment is enhanced.

Therefore, it is a primary object of the present invention to provide an improved means and apparatus for treating the surfaces of abrasive belts during operation thereof for the removal of adherent debris encountered during stock removal.

It is yet a further object of the present invention to provide an improved apparatus for application of a flow of compressed air or other fluid onto the surface of a rapidly moving abrasive belt, and wherein the delivery of such compressed fluid is accomplished on an intermittent pulsating basis and within a shroud.

It is still a further object of the present invention to provide an improved apparatus for the removal of accumulated material from the surface of a moving endless abrasive belt, and wherein the material or particles removed are captured within a shroud and removed through adjacently disposed evacuation ducts.

Other and further objects of the present invention will become apparent to those skilled in the art upon a study of the following specification, appended claim, and accompanying drawings.

DESCRIPTION OF THE PREFERRED EMBODIMENT

Figure 1:
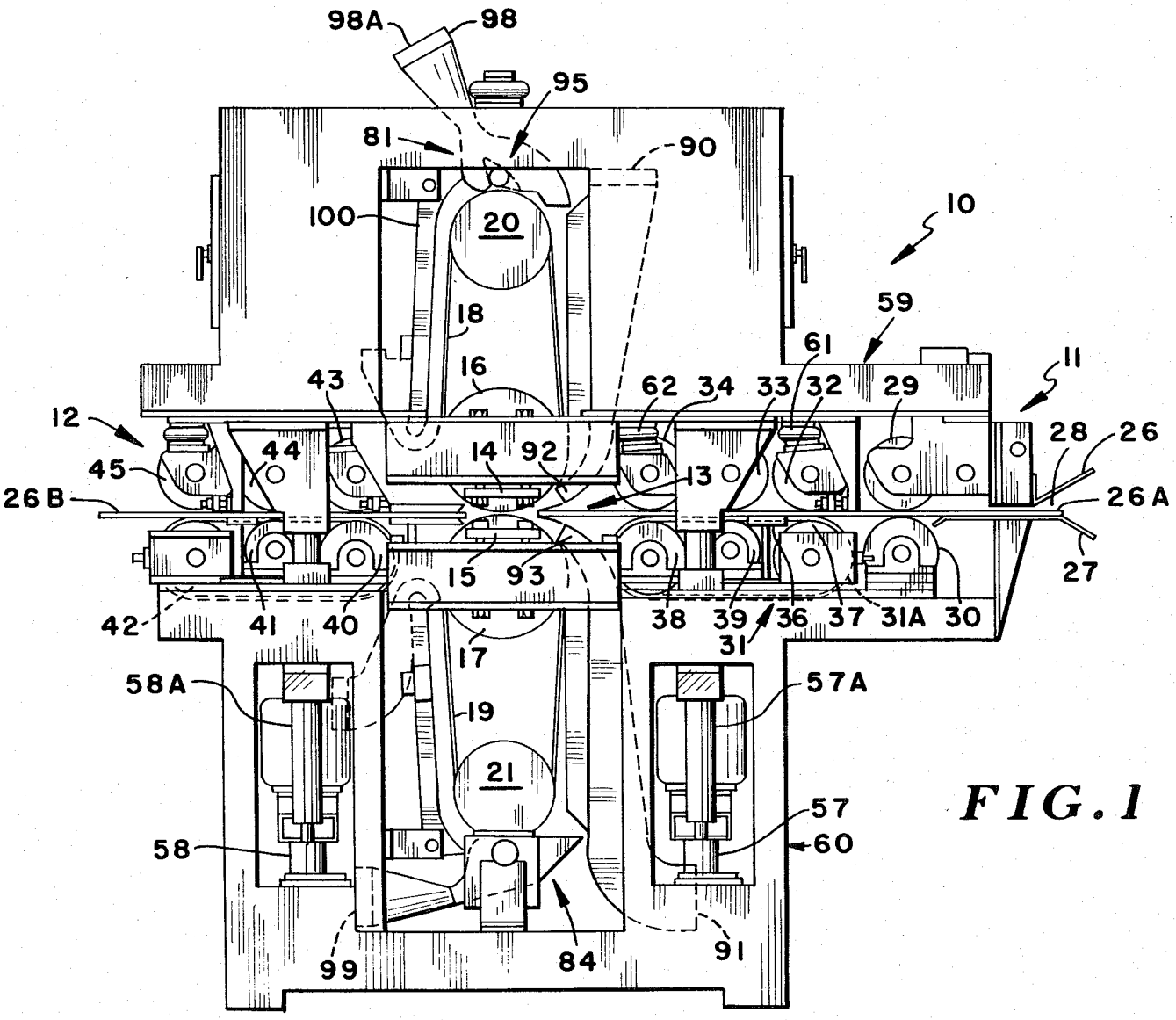
FIG. 1 is a side elevational view, partially in phantom, and illustrating a typical lumber dressing and dimensioning machine which has been equipped with the belt cleaning system of the present invention.

In accordance with the preferred embodiment of the present invention, and particularly as illustrated in FIG. 1, the abrasive sanding or grinding apparatus generally designated 10 includes an infeed conveyor segment shown generally at 11, and an outfeed conveyor segment shown generally at 12. Disposed centrally of the respective conveyor sections is a grinding and abrading section shown generally at 13, with the grinding and abrading section 13 including an upper abrading head 14 and a lower abrading head 15. As is apparent, abrading head 14 includes driven contact drum 16, while lower abrading head 15 includes driven contact drum 17. Upper belt 18 is provided along with lower belt 19 in order to achieve the appropriate sanding or griding operations at the tangential contact points. Upper idler roll 20 is provided, where indicated, for the upper abrading head system, with lower abrading head system being provided with lower idler roll 21. The drums 16 and 17 and rolls 20 and 21 are all preferably mounted for rotation upon parallel axes, with the running axis of each of the idler rolls 20 and 21 being arranged for controllable repositioning to maintain the abrasive belts in proper running orientation relative to the individual rollers. For most purposes, it will be recognized that the upper and lower abrading heads 14 and 15 respectively are complementary, one to another, and perform in substantially the same function and manner.

It is recognized that either of the drums in the system may be power driven, however in this instance, the contact drum of the abrading head is driven. This drive system, therefore, causes the endless belt to travel at a relatively high linear velocity, and thereby brings the entire length of the belt into working relationship with the work. Also, typical belt speeds average in excess of 6000 surface feet per minute, with the direction of rotation of the contact drum being opposed to the lineal direction along which the work is being moved.

Turning now to further details, the infeed 11 includes infeed deflectors 26 and 27 which form an infeed throat area as at 28. The infeed conveyor includes a pair of opposed infeed conveyor draw rolls 29 and 30, the former of which is sensing, either or both of which may be power driven, along with a second series of drawing means as is shown generally at 31. In order to control the edge travel of the work, infeed edge guides and outfeed edge guides are shown at 26A and 26B respectively. Such edge guides are, of course, conventionally employed in connection with this type of equipment. The second draw means includes a belt 31A having a relatively high friction surface, along with opposed conveyor pressure rolls 32, 33 and 34. The relative spacing between the upper surface or working surface of belt 31A and conveyor pressure rolls 32, 33 and 34 may be adjusted to accommodate work of varying thickness. One or more infeed pressure shoes may be disposed along the path of endless belt 31A, such as at 36. Preferably, one of the drums or rollers about which belt 31A is trained is power driven, such as conveyor roller 37, it being appreciated, of course, that the conveyor roller at the opposed end as at 38 may likewise be power driven. Generally, the intermediate conveyor pressure roller as illustrated at 39 is in the form of an idler, merely journaled for rotation as indicated. It will be further appreciated that no unusual drive features are required, with the various shafts supporting the rollers 31, 32, 33 and 34 and 37 and 38 being retained in suitable journal bearings disposed in the side frames of the structure.

Figure 2:
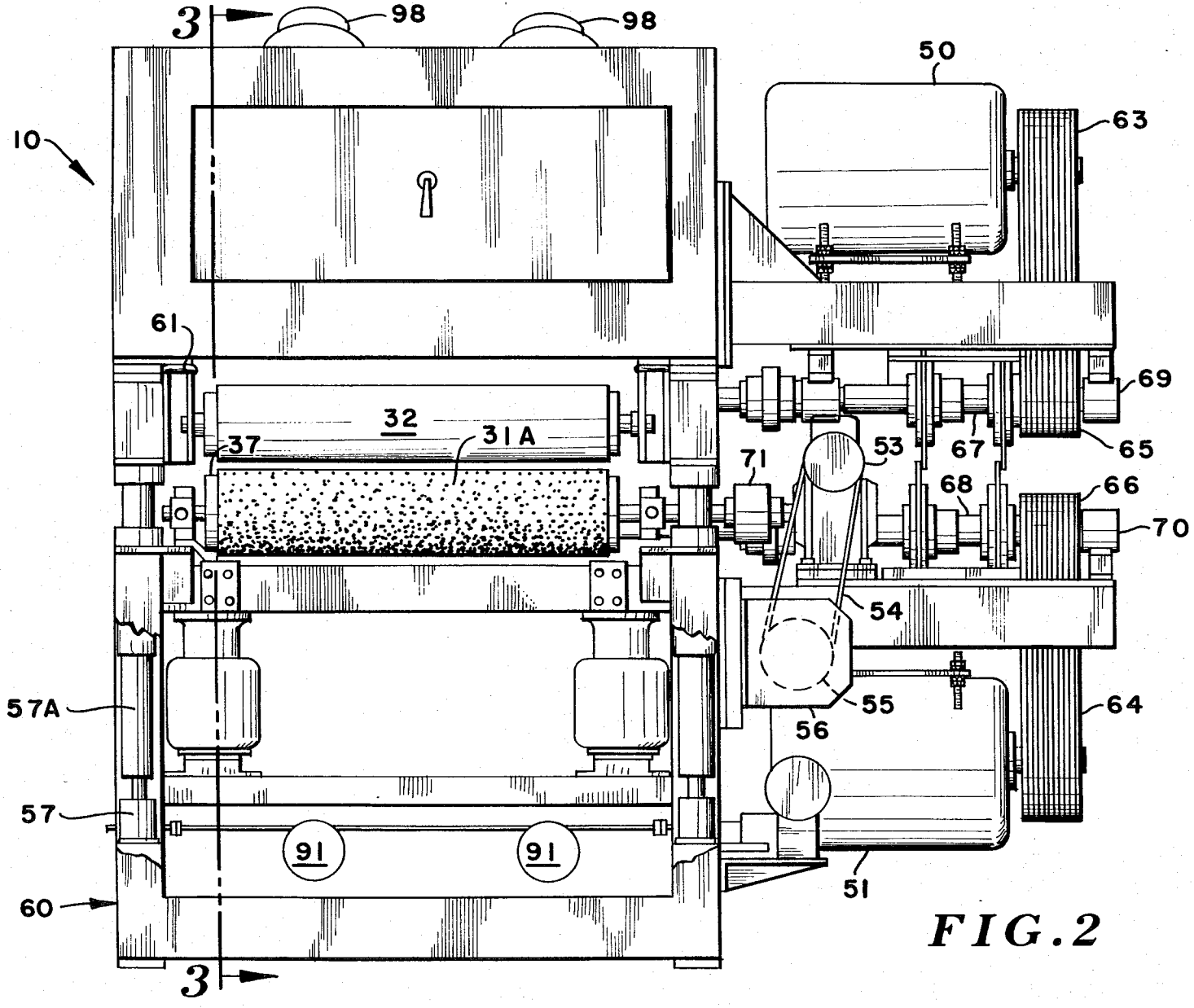
FIG. 2 is a front elevational view of the device illustrated in FIG. 1, with portions of the conveyor mechanism being illustrated along with the drive mechanism and dust control outlets.

The outfeed conveyor is generally similar to the infeed conveyor, and includes a conveyor draw roller as at 40, together with an idler as at 41. Opposed pressure rollers are provided at 43, 44 and 45, as is indicated. Preferably, conveyor draw roller 40 is power driven, and other rollers may also be driven if desired. Power for driving the individual elements of the conveyors may be obtained from separate motor sources, if desired, although such power may also be obtained from the main driving motors 50 and 51, as illustrated in FIG. 2, with the power for the conveyors being obtained from transmission 53 carrying endless belt 54, with endless drive belt 54 driving pulley 55. Housing 56 contains a conventional drive system for delivering power to each of the individual elements of the conveyor system, as is conventional in this type of apparatus.

In order to appropriately adjust the height of the conveyors, and thus adjust the elevation of the plane of the work relative to the abrading heads, jacks are provided as at 57 and 58, each having extension columns such as at 57A and 58A for adjustably orienting the upper units supported by frame means generally designated 59 from the lower units supported by frame means generally designated 60, to enable the relative spacing between the abrading heads to accommodate different size stock or work material, and also to provide for adjustment of the depth of cut to be undertaken by each abrading head.

In order to achieve proper movement of the work through the infeed and outfeed conveyors, the various sets of feed rollers and cooperating pressure rollers may be cushioned pneumatically, such as at 61 and 62 to achieve and maintain frictional engagement between the conveyor mechanism and the work. Also, edge guides may be provided along the length of the conveyor if desired, with such edge guides being, of course, well known and commercially available.

Attention is now directed to FIG. 2 of the drawings wherein the details of the power drive arrangements are illustrated. Specifically, two main drive motors are provided as at 50 and 51, with each carrying a plurality of "V" drive belts as at 63 and 64, these drive belts being, as is conventional, trained about suitable pulleys. Driven pulleys 65 and 66 are arranged fast on main drive shafts 67 and 68 respectively, each of which is journaled for rotation within appropriate bearing structures such as at 69 and 70. Drive shaft 68, as indicated, is coupled to transmission 53, and is further coupled to drive coupling 71 for directing power to the lower abrading head. As can be appreciated, motors 50 and 51 are preferably powered electrically, and are, of course, conventional and commercially available. While it is not critical that both upper and lower abrading heads operate at the same r.p.m., such an arrangement is nevertheless generally desirable.

Figure 4:
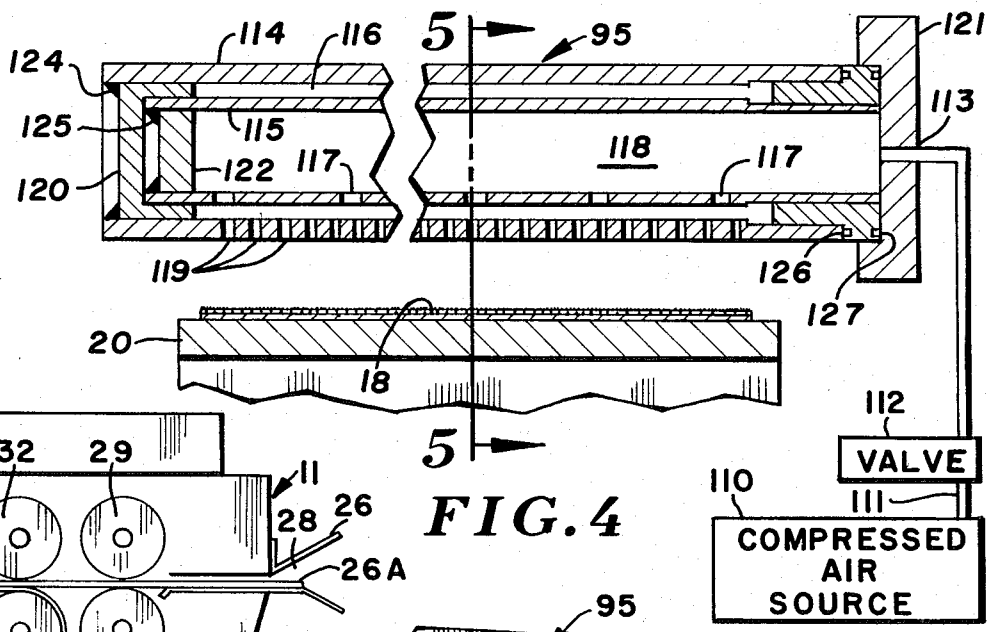
FIG. 4 is a fragmentary sectional view of the dust removal portion of the structure of the present invention, and illustrating, on a slightly enlarged scale, the debris removal elements of the structure as this portion of the structure relates to the idler roll carrying the abrasive belt.
Figure 5:
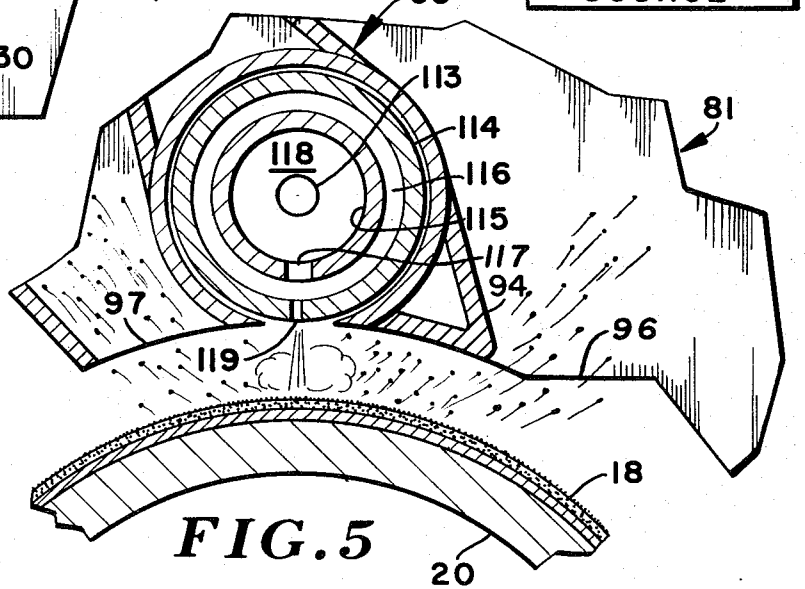
FIG. 5 is a vertical sectional view taken along the line and in the direction of the arrows 5—5 of FIG. 4.
Figure 3:
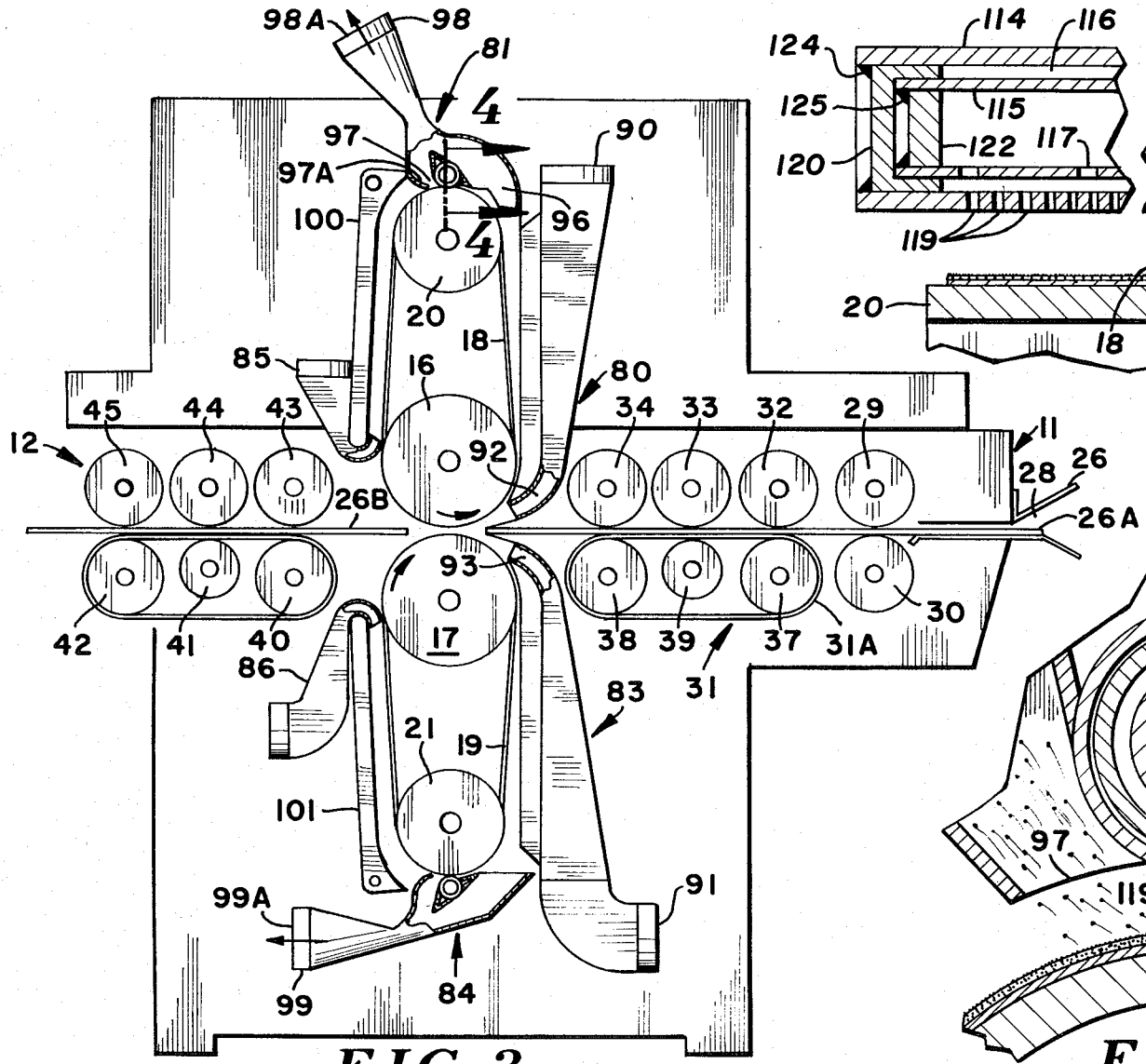
FIG. 3 is a vertical sectional view taken along the line and in the direction of the arrows 3—3 of FIG. 2.

Attention is now directed to FIGS. 3, 4 and 5 wherein details of the shrouded abrasive belts and cleaning means are illustrated. In FIG. 3, the upper abrasive belt 18 is substantially shrouded by upper infeed dust hood generally designated 80, and upper idler dust hood shown generally at 81. The lower abrasive belt 19 is provided with a lower infeed dust hood generally designated 83 and a lower idler dust hood shown generally at 84. Secondary pickups for dust particles for both upper and lower belts 18 and 19 are shown at 85 and 86 respectively.

With continued attention being directed to FIG. 3 of the drawings, upper infeed dust hood 80 is coupled to a source of vacuum (not shown) as illustrated at 90, with lower infeed hood 83 being coupled in turn to a source of vacuum as at 91. Air is therefore caused to flow from the inlet throat 92 and 93 of the upper and lower infeed hoods respectively so as to remove a substantial portion of the free floating particles at the source of their generation. Ordinary sheet metal may be employed to form the housings and enclosures for each of the dust hoods.

Belt speeds are substantial in this type of equipment, and in many commercially available units, belt speeds of up to 12,000 feet per minute are utilized. While such an arrangement may generate a certain moderate air flow, it remains important to provide a backing source for removal of particles. Generally speaking, flow velocities in the hoods, particularly adjacent the belt, are in the range of approximately 6000 feet per minute or perhaps greater.

Turning now to the details of the idler dust hoods 81 and 84, these hoods are shown in greater detail in FIG. 5, and include nozzle means for delivering pulses of compressed air onto the belt surface, as shown generally at 95, with evacuating throats for the air so delivered, along with other entrained particles and entrained air being shown at 96 and 97. Also, as is illustrated in the drawings, the distal ends 98 and 99 of upper and lower idler hoods 81 and 84 respectively are coupled to sources of vacuum, not shown, with the air flow being in the direction of the indicating arrows. Flow velocities in these hoods, particularly adjacent the opening exposed to the abrasive belt is approximately 6000 feet per minute. Other operating parameters, including the discharge of compressed air onto the surfaces of the moving belts will be described in greater detail hereinafter.

Additional shrouds or hoods are provided for the belts 18 and 19 as at 100 and 101 respectively. These hoods provide a means for guiding or otherwise controlling the flow of dust particles from the back side of the belt to the secondary pickup columns 85 and 86 respectively. Therefore, essentially the entire working and running areas of belts 18 and 19 are generally enclosed or shrouded so that the discharge of dust particles into the ambient is significantly reduced. This, of course, is an important element with high speed abrasive sanding or grinding equipment.

Turning now to the details of the means for discharging compressed air onto the surfaces of the moving belts, specific attention is directed to FIGS. 4 and 5 wherein a source of compressed air 110 delivers its flow of compressed air or other gaseous fluid to discharge line 111, through control valve 112, and thus through inlet port 113 of the means for delivering pulses of compressed air onto the belt surface 18. The means for delivering pulses of compressed air onto the belt surface 95 include an outer sleeve member 114 together with an inner sleeve member 115, which are spaced apart by annular zone 116. Air entering member 115 through inlet port 113 passes through spaced inner ports 117—117, thus escaping from an inner manifold 118 to the annular zone 116, and thence outwardly through deliver ports 119—119. Ports 119 accordingly deliver controlled pulses of compressed air or other gaseous fluid onto the surface of belts 18 and 19, such as is illustrated at FIG. 4 as well as at FIG. 5. The discharged compressed fluid accordingly passes onto the surface of the adjacent belt, and under the influence of the lower absolute pressure within the confines of the idler dust hood, moves through the evacuating system and thence outwardly through ports such as ports 98A and 99A. The dust laden air is then transferred through suitable conduits to a filter, bag house, or other air-solid particle separating means. Such air-solid particle separating means are, of course, commercially available and well known in the art.

As is apparent in FIG. 3 of the drawings, the throat 97 is defined at least in part by baffle plate or surface 97A. This baffle arrangement, which extends to a point adjacent the surface of the abrasive belt, provides a means for controlling flow of air from the idler surface away from the apparatus. Air flow is established at this point by virtue of the discharge of compressed air from nozzles or ports 119, along with the flow of air induced by the motion of the belt. As is apparent in FIG. 3, the shroud 100 acts as a continuation of the enclosure surrounding the belt, with the air flow moving through the evacuation port at the base of shroud 100, and thence outwardly through the port of secondary pickup 85. Also, in order to reduce the generation of zones of turbulence, a tapered air foil 94 is provided on the downstream side of the nozzle means 95 with this foil being shown in detail in FIG. 3.

In order to appropriately seal inner sleeve member 115 from outer sleeve member 114, a pair of end caps are provided as at 120 and 121, with a secondary end cap being provided in inner conduit 115 as at 122. Suitable welds may be made as at 124 and 125 to retain the individual elements of the assembly in proper position, and furthermore, annular seals may be provided in the form of "O" rings as at 126 and 127 adjacent end cap 121.

With continued attention being directed to FIG. 4 of the drawings, typically, valve 112 will be actuated so as to deliver a flow of compressed fluid to belt surface 95 for intermittent pulses of between about 15 and 30 seconds duration. Furthermore, and typically, the compressed air is discharged onto the belt surface for a fraction of the operation time, with the balance of the time being undertaken with valve 112 being closed and with the compressor recovering. While the capacity of the compressor source may determine the fraction of the operation time for the discharge of compressed fluid onto the belt, it has been found that good results are achieved when the compressed air is discharged onto the belt surface for between about one-fourth and one-half of the total operation time. By utilizing this technique, therefore, a smaller compressor source may be utilized for the compressed air, with a lower overall volume of compressed gaseous fluid (air) being required, and with enhanced cleaning results being achieved as well.

We claim:

1. Dry abrading apparatus comprising, in combination:

(a) means moving a flexible endless abrasive belt in a closed orbital path around a contact roller and an idler roller spaced therefrom for abrading engagement with a workpiece generally along a first contact line at the periphery of said contact roller and extending generally laterally between the ends thereof, said belt having a first portion moving away from said contact roller and a second portion moving toward said contact roller;

(b) belt shrouding means comprising an infeed dust hood extending adjacent said first belt portion, a secondary dust pickup extending adjacent said second belt portion, and an idler dust hood adjacent to and extending around a portion of said idler roller between said infeed hood and said secondary dust pickup;

(c) said infeed hood having a suction inlet extending the width of said belt at a site along the belt path immediately following said first contact line;

(d) said secondary dust pickup having a suction inlet extending the width of said belt at a site along the belt path prior to said first contact line;

(e) said idler dust hood comprising:

(1) nozzle means for directing laterally spaced jets of gaseous fluid generally normal to and against the surface of said belt in a direction radially inwardly of said idler roller and along a second contact line extending generally laterally of said belt as the belt passes around said idler roller, said second contact line being disposed substantially midway of the arcuate contact wrap of said belt with said idler roller; and (2) a suction inlet in immediate apposition with the portion of said idler roller between said infeed hood and said secondary dust pickup, and extending in both arcuate directions from said second contact line, and laterally enveloping said second contact line and extending along and shrouding said belt in both said first and second belt portions;

(f) suction means connected to said infeed hood, said secondary dust pickup, and said idler hood;

(g) means for cyclically supplying gaseous fluid to said nozzle means for finite repeated time periods, with periods of supply of gaseous fluid being interrupted by finite time periods of quiescence, to periodically dislodge from said belt particles embedded thereon; so that particles released from said belt at said contact roller are received in said infeed hood, and particles released from said belt at said idler roller are received in said idler hood; and (h) air foil means disposed within said idler dust hood and encompassing said nozzle means and tapered in a direction extending toward the approaching belt, to reduce the turbulence of gas accompanying the belt and approaching said idler dust hood.

* * * * *